United States Patent [19]

Beinhaur et al.

[11] Patent Number: 4,473,715

[45] Date of Patent: Sep. 25, 1984

[54] WIRE CONNECTOR

[75] Inventors: Ernest L. Beinhaur, Harrisburg; Michael P. Green, Mechanicsburg, both of Pa.

[73] Assignee: AMP Incorporated, Harrisburg, Pa.

[21] Appl. No.: 547,142

[22] Filed: Oct. 31, 1983

[51] Int. Cl.[3] ..... H01R 4/22

[52] U.S. Cl. ..... 174/87; 339/67

[58] Field of Search ..... 174/87, 203; 339/67; 267/166, 168, 61 R

[56] References Cited

U.S. PATENT DOCUMENTS

| | | | |
|---|---|---|---|
| 1,460,624 | 7/1923 | Van Gelderen | 174/87 |
| 3,297,816 | 1/1967 | Waddington | 174/87 |
| 3,440,332 | 4/1969 | Blomstrand | 174/87 |
| 3,497,607 | 2/1970 | Swanson | 174/87 |
| 3,676,574 | 7/1972 | Johansson et al. | 174/87 |
| 4,065,637 | 12/1977 | Allison | 174/87 |
| 4,112,251 | 9/1978 | Scott | 174/87 |
| 4,288,657 | 9/1981 | Swanson | 174/87 |

*Primary Examiner*—John Gonzales
*Assistant Examiner*—Morris H. Nimmo
*Attorney, Agent, or Firm*—F. Brice Faller; Russell J. Egan

[57] ABSTRACT

Wire connector comprises a terminal of wound spring wire which is received in a cavity in a plastic base and contained therein by a plastic cover. The terminal comprises a first conical helix wound from a wire receiving end to a constricted end then back upon itself to form a shorter second helix ending at a shoulder. Conductors are twisted into the terminal causing it to expand and grip the conductors resiliently while a finger of spring metal prevents rotation relative to the housing. The first helix is nested in U-shaped recesses in partitions in the cavity so that the shoulder bears against a partition when the wires are pulled.

8 Claims, 8 Drawing Figures

WIRE CONNECTOR

BACKGROUND OF THE INVENTION

The present invention relates to a wire connector.

Wire connectors are simple electrical connectors which receive twisted conductors and hold same together in twisted formation. Many wire connectors employ helical spring wire inserts whose coils act as threads which draw bare wire into the connector and further to assure good electrical connection. These most commonly have a helix rigidly set in a cavity in a plastic cap. The insert cuts a helical path in the conductors which serves to retain the conductors in the connector; however, there is no resilient spring force on the wires. Such wire connectors are only suitable for a limited range of wire sizes.

The advantages of a helical spring fit with some clearance in an insulating cap are recognized in U.S. Pat. No. 1,460,624, which discloses a helix which may expand within certain limits. This not only permits accommodating a wider range of wire sizes but aids in resilient gripping of the wires. The helix is biconical in shape so that only the larger convolutions at the inner end of the spring engage the walls of the bore in the cap when the helix is threaded therein. Any pulling of wires twisted into the helix causes it to grip the wires more strongly since the effective diameter of the helix in the wire gripping area decreases in the fashion of novelty finger handcuffs. Such a decrease at the large convolutions at the inner end of the spring could cause it to pull free of the cap. Further, a reverse twist on the wires could cause the helix to thread out of the cap.

A wire connector employing the above described principle of resiliency which would lend itself readily to automated manufacture and provide a practically irreversible twisted wire termination would be desirable.

SUMMARY OF THE INVENTION

The present invention lies in a wire connector having a terminal of spring wire wound into a first conical helix thence back upon itself from the constricted end thereof to form a second helix ending at a shoulder on the surface of the first helix. A two-piece plastic housing comprising a cover hinged to a base receives the terminal in a cavity in the base and is completed by staking the cover thereto. The terminal rests loosely in the cavity to allow expansion as wires are twisted in and has a finger extending from the shoulder which prevents the terminal from turning in the housing. The shoulder rests against a partition in the housing to resist axial removal of the terminal while freely permitting constriction of the coils when the wires are pulled. The second helix also provides additional resilience during wire insertion since torsional loading is transferred directly thereto from the first helix.

As the housing may be molded in continuous strip form, assembly of the wire connectors may readily be automated. A connector which can accommodate a variety of wire sizes in a foolproof termination which is economical to manufacture is thus achieved by the present invention.

DETAILED DESCRIPTION OF THE PREFERRED EMBODIMENT

Figure 1:
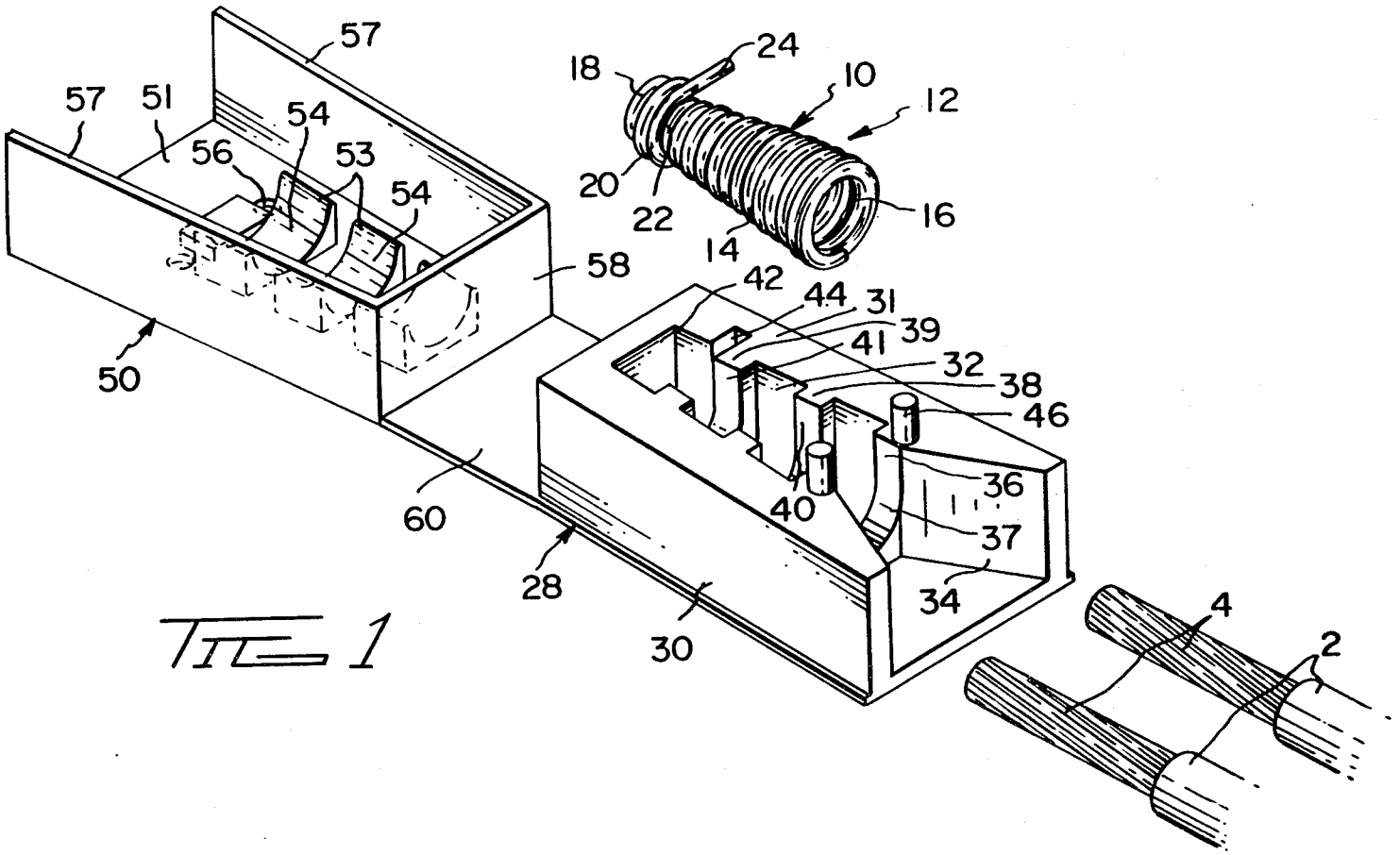
FIG. 1 is an exploded perspective of the wire connector.

FIG. 1 is an exploded perspective of the wire connector of the present invention, which comprises a terminal 10 which fits into a molded housing 28 and is used to connect the standard conductors 4 of wires 2. The terminal 10 is a length of spring wire 12 which is helically wound in a clockwise direction from a wire receiving end 16 to a constricted end 18 to form a first helix 14, thence back upon itself to form a second helix 20. The second helix 20 extends from constricted end 18 to a shoulder 22 on the outside of first helix 14; a finger 24 of spring wire 12 extends from said shoulder 22 tangentially to said first helix 14.

Figure 2:
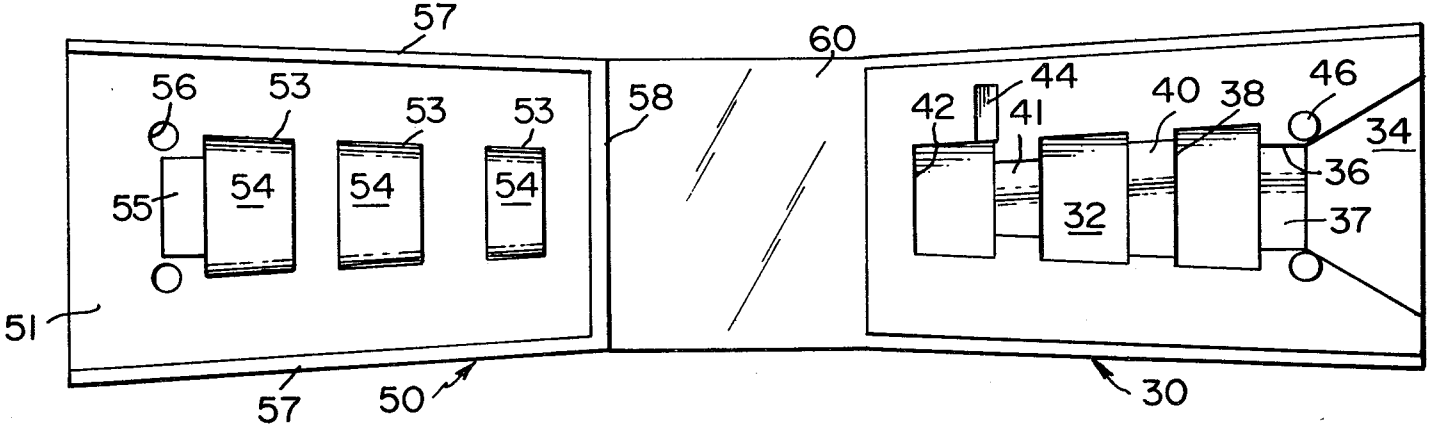
FIG. 2 is a plan view of the base and cover.
Figure 2A:
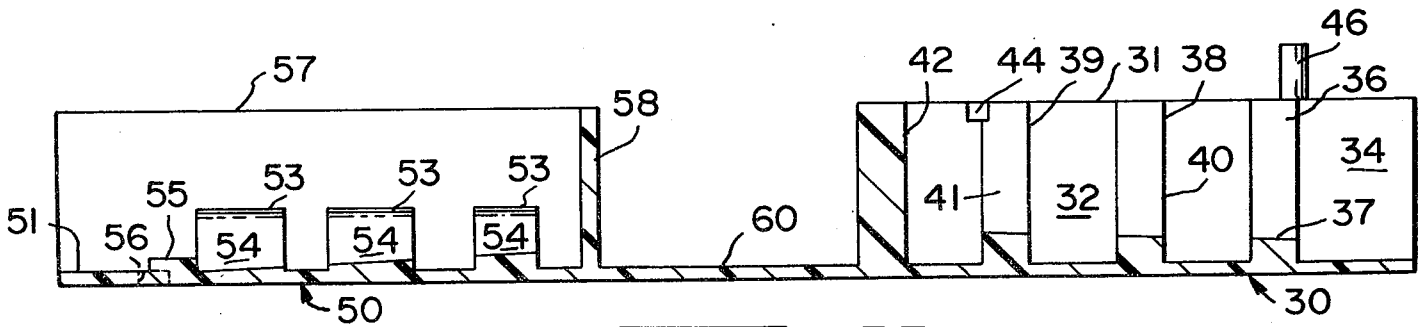
FIG. 2A is a side view of the base and cover.

Referring to FIGS. 1, 2 and 2A, the housing 28 is molded of polypropylene in two parts, base 30 and cover 50, which are connected by hinge 60. The base 30 has an inside face 31 having a cavity 32 profiled therein. The cavity 32 is interrupted by partitions 38, 39 having respective U-shaped recesses 40, 41 which open on face 31. The cavity 32 is bounded by a wall 36 having a U-shaped recess 37 therein providing access from entry 34, and is oppositely bounded by endwall 42. The inside face 31 has a groove 44 therein which intercepts cavity 32 between partition 39 and endwall 42; the groove 44 is profiled to receive finger 24. The cover 50 has an inside face 51 bounded by sidewalls 57 and endwall 58. Upstanding walls 53 on face 51 are profiled to fit into cavity 32 adjacent partitions 38, 39; U-shaped recesses 54 in walls 53 are profiled to cradle terminal 10. Platform 55 extending from outermost wall 53 is profiled to fit in the top of U-shaped recess 37. Apertures 56 through face 51 are spaced to receive studs 46 on face 31 when cover 50 is folded against base 30.

Figure 3:
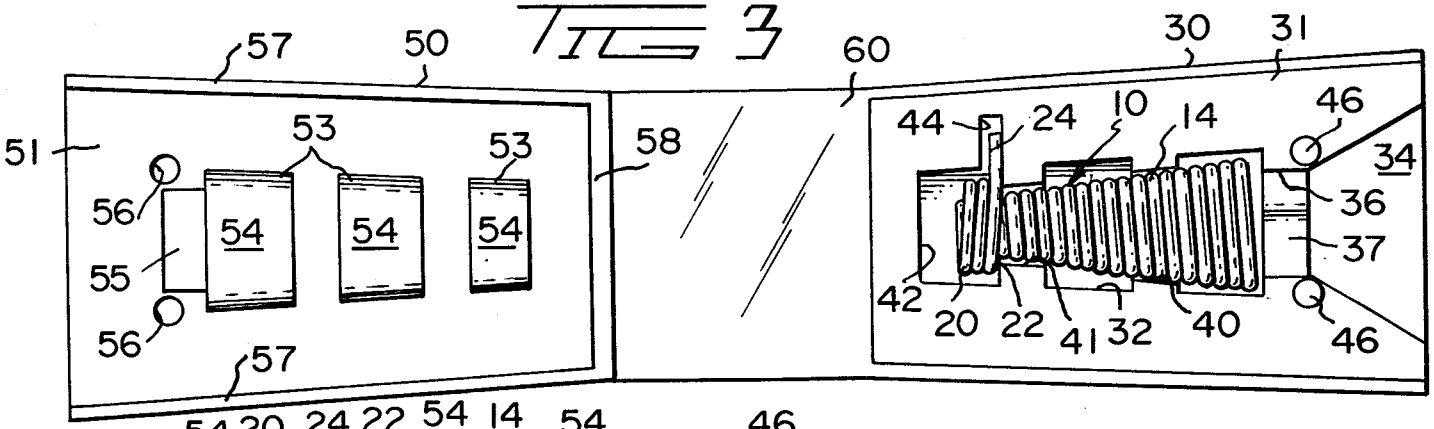
FIG. 3 is a plan view of the base with the terminal inserted.
Figure 5:
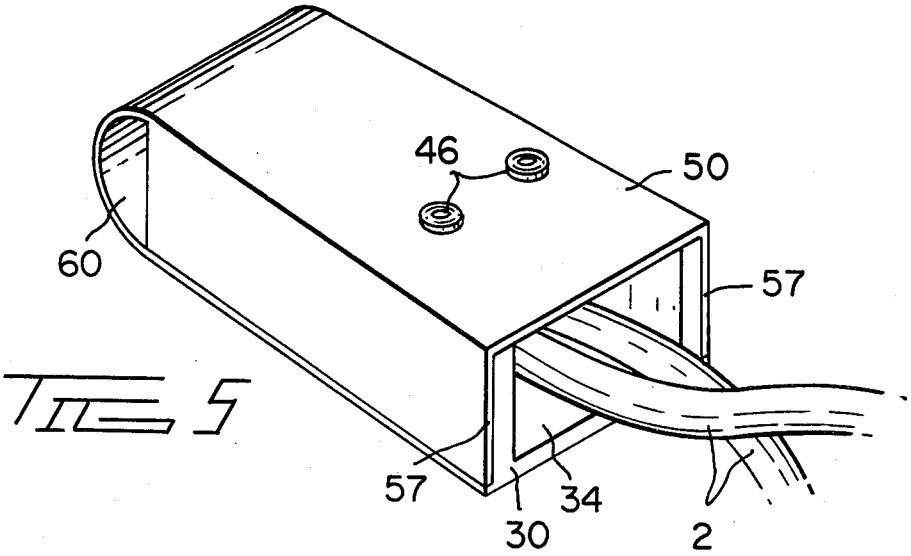
FIG. 5 is a perspective of the assembled connector with wires inserted.

FIG. 3 is a plan of the housing 28 after terminal 10 has been dropped into cavity 32. First helix 14 is cradled in U-recesses 40; second helix 20 fits between partition 39 and endwall 42 so that shoulder 22 is against partition 39, and finger 24 lies in groove 44. The next step in the assembly of the wire connector is folding cover 50 over on the base 30 to entrap the terminal 10 in cavity 32. The studs 46 are then staked to cover 50 by ultrasonic welding or heat. The assembled wire connector is then employed in standard fashion by inserting the stripped ends of wires 2 into entry 34 and twisting clockwise to draw the strands into the terminal, as shown in FIG. 5.

Figure 4:
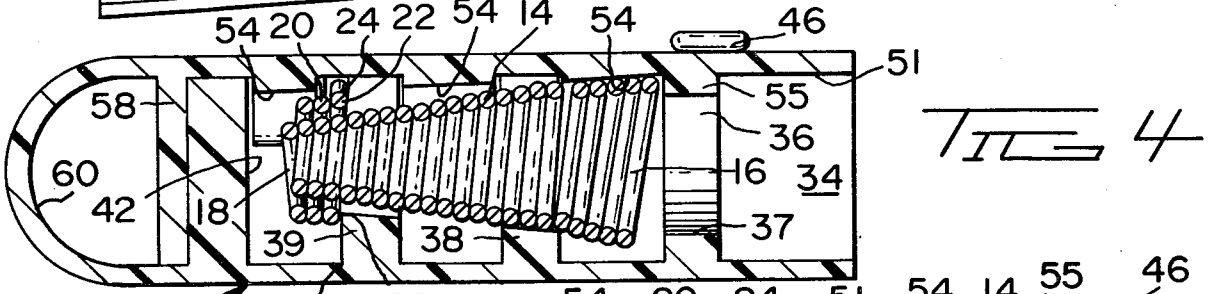
FIG. 4 is a side cross section of the assembled connector without wires.

FIG. 4 is a side cross section of the assembled wire connector prior to wire insertion. The terminal 10 is cradled between U-recesses 40, 41 in partitions 38, 39 on base 30 and U-recesses 54 in walls 53 on cover 50. Second helix 20 is situate between partition 39 and endwall 42; shoulder 22 limits axial movement toward entry 34. A slight clearance between terminal 10 and housing 28 is necessary to allow for some radial expansion of the terminal 10. Rotational movement is prevented by finger 24 (FIG. 3).

Figure 4A:
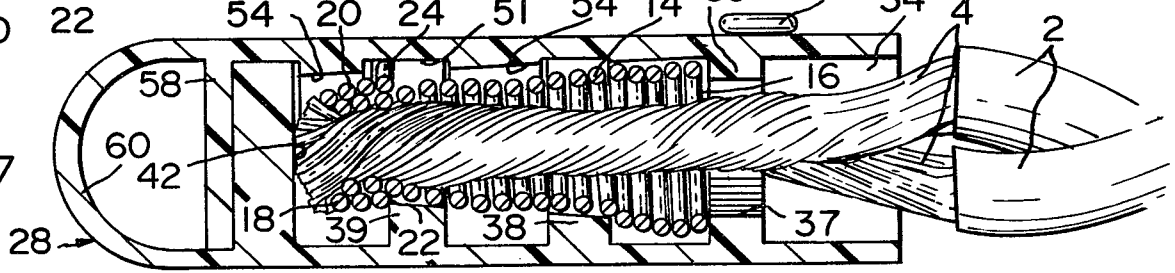
FIG. 4A is a side cross section of the assembled connector with wires inserted.

FIG. 4A is a cross section of the wire connector after stranded conductors 4 are inserted therein by twisting to draw the conductors into first helix 14 from wire receiving end 16 to constricted end 18. As the spring metal, typically steel, is harder than the conductors 4, typically copper, the helix 14 cuts a helical path into the conductors 4 so that they are drawn in as a screw. This cutting action is minor in comparison to that caused by rigid threads found in many prior art wire connectors. As the first helix 14 is free to expand radially, this expansion occurs as the conductors 4 are twisted therethrough where the conductors are in contact with the helix 14 toward constricted end 18. The coils expand to accommodate the conductors 4 and are resiliently loaded thereagainst toward constricted end 18. During insertion of the conductors 4 and the concomitant expansion of the coils of first helix 14, some twisting of the terminal 10 relative to the housing 28 occurs, except where spring finger 24 rests in groove 44. This twisting is continuous through second helix 20, which is thus torsionally loaded during insertion of conductors 4. When insertion is complete as shown in FIG. 4A, helixes 14, 20 reverse twist as torsional loading is released. The conductors are then retained in terminal 10 by resilience of the expanded coils.

Just as helixes 14, 20 expand during insertion of conductors 4 by clockwise rotation, couterclockwise rotation of the conductors causes the coils of helixes 14, 20 to constrict, thus increasing their grip on the conductors 4. The second helix 20 provides additional constrictive force, and further provides a shoulder 22 which bears on partition 39 when wires 2 are pulled axially. The wire receiving end 16 of first helix 14 is spaced slightly from wall 36 so that pulling the wires 2 puts second helix 20 in compression and first helix 14 in tension where the conductors 4 are gripped toward constricted end 18. Since tension causes a helix to elongate and reduce in diameter in the area of elongation, pulling of wires 2 causes the first helix 14 to constrict and increase its grip in conductors 4. The amount of elongation is limited as wire receiving end 16 bears against wall 36, thus preventing streching out the first helix 14.

Figure 6:
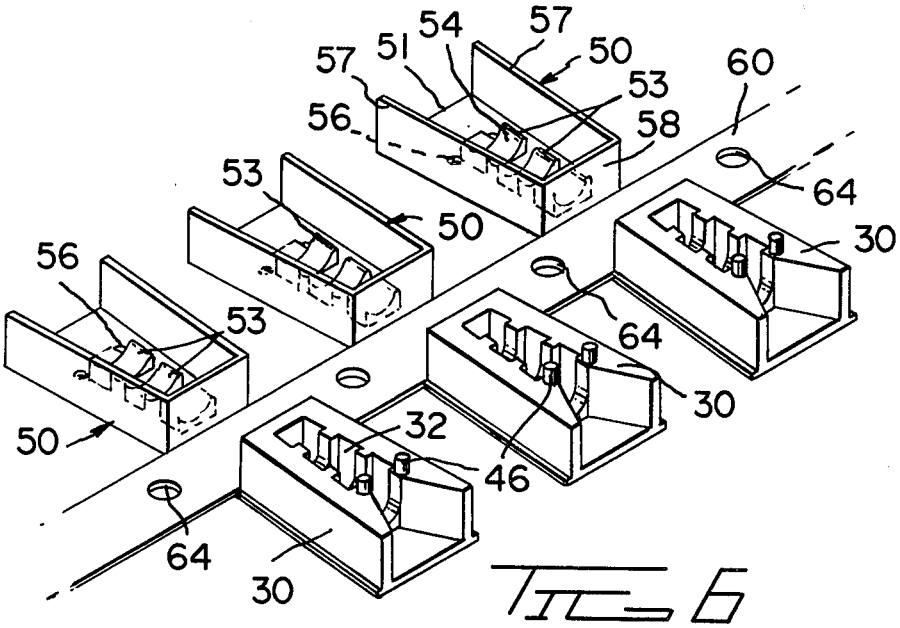
FIG. 6 is a perspective of a continuous strip of housings.

FIG. 6 is a perspective of a continuous strip of housings 28 which may be most aptly manufactured on a molding wheel as disclosed in U.S. Pat. No. 4,159,300. Each base 30 and cover 50 are connected by a hinge 60, the connecting strip 62 running continuously through all hinges 60. The strip 62 is provided with indexing holes 64 to facilitate automated insertion of terminals, and subsequent folding over of coner 50 against base 30. The terminal and two-piece housing of the present invention thus readily lend themselves to automated assembly of a low-cost wire nut of rectangular shape. The shape offers the advantage of providing flat surfaces for labeling. The plastic is preferably a translucent polypropylene so that effective termination may be assured visually.

While the primary advantages of the double helix type terminal of the present invention are realized with a housing, it may also be used to manufacture a simple ring-type connector by bending one or two coils at the constricted end of the terminal through ninety degrees. Insulation could be provided by placing shrink tubing over the remaining coils.

The foregoing description is exemplary and not intended to limit the scope of the claims which follow.

We claim:

1. An electrical connector for joining a plurality of wires together comprising a terminal having a length of spring metal formed into a first helix to define a wire receiving first end and a constricted second end, said helix decreasing in diameter from said first to said second end, and a second helix formed about the outside of said first helix from said second end extending towards said first end and terminating in a shoulder, said length of spring metal being wound continuously in the same rotational direction to form both said helixes.

2. An electrical connector as in claim 1 which further comprises a housing having a terminal receiving cavity therein, said housing having a wire receiving entry to said cavity, said terminal being nested in said cavity with said wire receiving end toward said entry, said cavity having clearance therein to allow radial expansion of said terminal, said cavity having a shoulder therein against which said shoulder of said terminal bears to prevent withdrawal thereof from said entry.

3. An electrical connector as in claim 2 wherein said housing comprises a base and a cover, said base having an inside face having said cavity profiled therein, said cavity being profiled to receive said terminal by movement laterally of its axis, said cover being profiled to assemble to said base by movement laterally of said cavity to entrap said terminal therein.

4. An electrical connector as in claim 3 wherein said cavity is interrupted by at least one partition having respective U-shaped recesses which open on said inside face, said recesses being profiled to cradle said terminal, one of said partitions forming said shoulder in said cavity.

5. An electrical connector as in claim 4 wherein said cover has an inside face having extending therefrom at least one wall having a respective U-shaped recess therein, said inside face of said cover fitting against said inside face of said base with said at least one wall fitting into said cavity adjacent a partition, said U-shaped recess in said wall being profiled to cradle said terminal.

6. The electrical connector of claim 3 wherein said base and said cover are molded of plastic with an integral hinge of plastic therebetween, said hinge permitting said cover to be folded over said inside face of said base.

7. The electrical connector of claim 2 wherein said spring metal extends from said shoulder of said second helix tangentially to said outside of said first helix to define a finger, said finger cooperating with said housing to prevent rotation of said terminal relative thereto.

8. The electrical connector of claim 1 wherein said spring metal is wound clockwise from said wire receiving end to said constricted end and from said constricted end to said shoulder.

* * * * *